US008910394B2

(12) United States Patent
Steffens

(10) Patent No.: US 8,910,394 B2
(45) Date of Patent: Dec. 16, 2014

(54) TUMBLE DRYER COMPRISING A HEAT PUMP AND HEATING SYSTEM AND METHOD FOR OPERATING THE SAME

(75) Inventor: Günter Steffens, Dallgow-Döberitz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 995 days.

(21) Appl. No.: 12/865,405

(22) PCT Filed: Jan. 28, 2009

(86) PCT No.: PCT/EP2009/050963

§ 371 (c)(1),
(2), (4) Date: Jul. 30, 2010

(87) PCT Pub. No.: WO2009/098158

PCT Pub. Date: Aug. 13, 2009

(65) Prior Publication Data

US 2011/0000099 A1 Jan. 6, 2011

(30) Foreign Application Priority Data

Feb. 7, 2008 (DE) ..... 10 2008 007 971

(51) Int. Cl.

| | |
|---|---|
| ***D06F 58/00*** | (2006.01) |
| ***F26B 3/00*** | (2006.01) |
| ***F26B 19/00*** | (2006.01) |
| ***F25B 29/00*** | (2006.01) |
| ***D06F 58/20*** | (2006.01) |
| *D06F 58/28* | (2006.01) |

(52) U.S. Cl.

CPC ..... *D06F 58/206* (2013.01); *D06F 2058/287* (2013.01); *D06F 58/28* (2013.01); *D06F 2058/289* (2013.01)

USPC ..... 34/132; 34/493; 34/549; 165/241

(58) Field of Classification Search

USPC ..... 34/132, 535, 418, 493, 549; 165/240, 165/241

See application file for complete search history.

(56) References Cited

U.S. PATENT DOCUMENTS 4,240,404 A * 12/1980 Franchina ..... 126/586
4,248,053 A * 2/1981 Sisk ..... 62/158
5,768,730 A * 6/1998 Matsumoto et al. ..... 8/159

(Continued)

FOREIGN PATENT DOCUMENTS

DE 4216106 A1 11/1993
DE 4023000 C2 2/2003

(Continued)

*Primary Examiner* — Kenneth Rinehart
*Assistant Examiner* — John McCormack
(74) *Attorney, Agent, or Firm* — Jordan IP Law, LLC; Todd A. Vaughn

(57) ABSTRACT

A tumble dryer having a drying chamber for articles to be dried; a process-air duct; a heater arranged to heat process air, wherein the heater is a two-stage heater having a first heating stage in a first circuit and a second heating stage in a second circuit that is parallel to the first circuit; a first fan to direct heated process air over the articles to be dried in the drying chamber; a heat pump having a heat sink, a heat source and a heat transfer device; a controller; and a thermostatic switch arranged in the first circuit or the second circuit, wherein the thermostatic switch is thermally coupled to the heat pump.

19 Claims, 1 Drawing Sheet

(56) References Cited

U.S. PATENT DOCUMENTS

| | | | | |
|---|---|---|---|---|
| 5,918,668 | A * | 7/1999 | Trimble | 165/240 |
| 2006/0122733 | A1* | 6/2006 | Harrod et al. | 700/276 |
| 2006/0263073 | A1* | 11/2006 | Clarke et al. | 392/347 |
| 2008/0289209 | A1* | 11/2008 | Han et al. | 34/74 |
| 2011/0005097 | A1* | 1/2011 | Moon et al. | 34/493 |

FOREIGN PATENT DOCUMENTS

| | | | |
|---|---|---|---|
| DE | 19738735 | C2 | 2/2003 |
| DE | 602004005036 | T2 | 11/2007 |
| JP | 2003-265889 | A | 9/2003 |

* cited by examiner

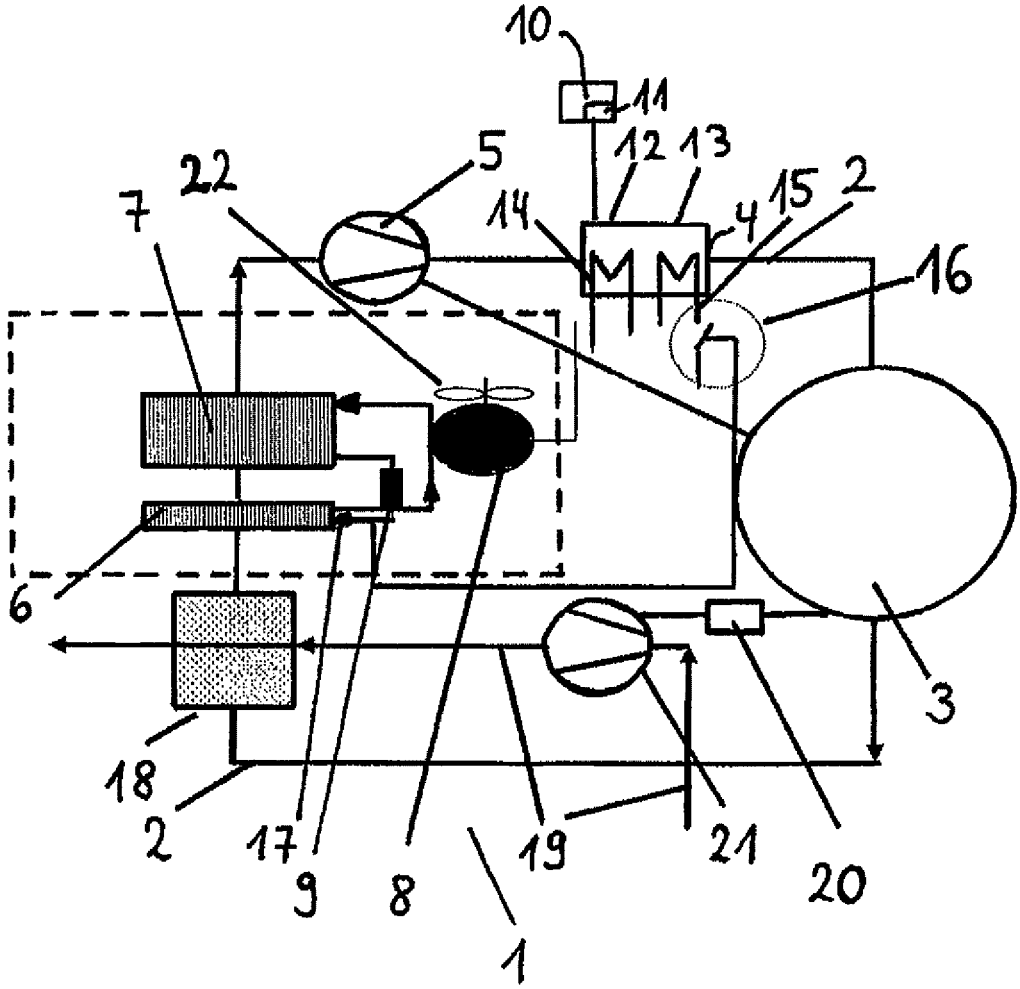
10
11
12
13
5
22
7
14
4
15
2
16
6
3
18
2
17
9
8
19
21
20
1

TUMBLE DRYER COMPRISING A HEAT PUMP AND HEATING SYSTEM AND METHOD FOR OPERATING THE SAME

BACKGROUND OF THE INVENTION

The invention relates to a tumble dryer comprising a drying chamber for the articles to be dried, a process-air duct, in which is located a heater for heating the process air and in which the heated process air can be directed by a first fan over the articles to be dried in the drying chamber, and comprising a heat pump having a heat sink, a heat source and a heat transfer device, and also a controller, and relates to a preferred method for operating said tumble dryer.

A conventional tumble dryer, whether or not it comprises a heat pump as a means of partial recovery of the thermal energy used to dry the washing that is provided, is designed either as a vented dryer or a condenser dryer.

In the vented dryer, ambient air is drawn in from around the tumble drier, heated and conducted once over the washing to be dried for the purpose of absorbing moisture, and then ducted out of the tumble dryer. Since it is moisture-laden, the air cannot simply be vented into a building in which the tumble dryer is installed, but must be ducted out of the building in a controlled manner via a venting hosepipe or the like. A tumble dryer in the form of a condenser dryer carries the process air used for drying the washing in a closed circuit, where it follows a cycle in which it is heated and directed over the washing and then cooled in order to condense the moisture that it is carrying and to separate it from the process air as condensate; the process air is then heated and guided over the washing again. A condenser dryer does not need a venting hosepipe and is very popular for installing in a bathroom with no outside walls or a laundry room with no outside walls and also in large apartment blocks.

In the condenser dryer (also referred to below as a "dryer" for short), the process air is conducted by a fan over a heating device into a rotating drum as the drying chamber containing damp laundry. The hot air takes the moisture out of the laundry to be dried. After passing through the drum, the now moist process air is conducted into a heat exchanger or another heat sink, in front of which is usually connected a lint filter for catching a lint, i.e. fine, suspended fabric particles that the process air draws from the washing to be dried. In the heat exchanger (e.g. air-air heat exchanger) or the heat sink, the moist process air is cooled so that the water contained in the moist process air condenses. The condensed water is then usually collected in a suitable container. The cooled and dried air is fed again to the heating device and then to the drum.

Each of the drying processes just described uses a large amount of energy, in the case of the vented dryer to take away the heated and moisture-laden airflow from the vented dryer after a single pass through the moist laundry, or in the case of the condenser dryer, in which a heat exchanger is used that is cooled by a cooling airflow or the like, because the heat removed in cooling the process air in the heat exchanger is conducted away in the cooling airflow and hence is lost to the drying process. This energy loss can be reduced significantly by using a heat pump instead of the heat exchanger. In a condenser dryer equipped with a heat pump, the warm, moisture-laden process air is cooled largely in a heat sink of the heat pump, for instance in an evaporator for a working fluid carried in a circuit in a heat transfer device, where the transferred heat is used to evaporate the working fluid. The heat-pump refrigerant vaporized because of the heating action is fed via a compressor in the heat transfer device to a condenser for the working fluid, which acts as a heat source, where the condensing of the gaseous working fluid releases heat that is used to heat the process air before entering the drum. The working-fluid circuit is closed in this heat pump by the working fluid returning to the evaporator via an expansion valve in the heat transfer device, where it expands to a lower internal pressure. Other forms of heat pump are known.

DE 40 23 000 C2 discloses a tumble dryer containing a heat pump of the type described above, in which an air-intake aperture is arranged in the process-air duct between the condenser and the evaporator, where said aperture can be closed by a controllable closure device.

DE 197 38 735 C2 describes a condenser dryer having a closed drying-air circuit, which is likewise equipped with a heat pump. The heat pump is designed on the absorber principle and its absorber forms a third heat exchanger, with the refrigerant flowing through its primary circuit, and the drying air flowing away from the second heat exchanger being fed via its secondary circuit back to the secondary circuit of the first heat exchanger.

Many known tumble-dryer heat pumps use compressors for cyclically vaporized and condensed working fluids. These fluids usually work best in specific temperature ranges. The problem with using such a compressor in the condenser dryer is that there are often high temperatures in the condenser, which by the nature of the process mean that the compressor needs to be switched off and/or the heat-pump efficiency worsens. This problem is even greater if an additional conventional heater, in particular an electric resistance heater, assists the compressor in the process-air circuit in order to achieve faster heating of the process air and/or shorter drying times. Hence it is often necessary to reduce the temperatures in the heat pump, for example by using an additional fan to produce a cooling airflow.

The commonly used air-air heat exchanger, whether operated in a cross-flow or counter-flow arrangement, and the electric heater are generally replaced together by a heat pump. This can achieve efficiency improvements of 20% to 50%. Extremely energy-efficient drying is possible in a dryer of this type. In general however, it cannot be used to achieve rapid drying. Moreover, although known conventional driers can usually dry damp laundry very quickly, this means that they also often have a very high energy consumption.

There are also driers in which a heat pump is used that contains a small compressor or a small refrigeration circuit, where a lack of heating or cooling power is made up for by an electric resistance heater or an air-air heat exchanger. A dryer of this type can be operated solely using the heat pump, using the heat pump and the electric resistance heater or using the resistance heater and/or the air-air heat exchanger.

BRIEF SUMMARY OF THE INVENTION

The object of the invention was hence to provide a tumble dryer comprising a heat pump, in which a conventional controller can also be used and an additional relay for the heat pump is not necessary. Preferably, in the dryer it shall also be possible to set a defined optimum working-fluid temperature easily.

Hence the subject matter of the invention is a tumble dryer comprising a drying chamber for the articles to be dried, a process-air duct, in which is located a heater for heating the process air and in which the heated process air can be directed by a first fan over the articles to be dried in the drying chamber, and comprising a heat pump having a heat sink, a heat source and a heat transfer device, and also a controller, wherein the heater is a two-stage heater having a first heating stage in a first circuit and a second heating stage in a second circuit parallel to the first, with a thermostatic switch that is thermally coupled to the heat pump being arranged in the first circuit or in the second circuit.

According to the invention, a controller for a tumble dryer without a heat pump and designed in general for a two-stage heater can be used for the tumble dryer comprising a heat pump. The heater and the heat pump are interconnected according to the invention such that the relay, which is actually not present for the dryer comprising the heat pump, is unnecessary; all components of the tumble dryer are connected to the controller and are integrated in the control of the drying process in accordance with regulations.

Likewise, it is not necessary to use a single-stage heater instead of the preferred two-stage heater in order to make a relay on the controller available for the heat pump. This removes a major disadvantage arising from the fact that the single-stage heater operating in parallel with the heat pump could only have a relatively low power, and hence it would not be possible using such a dryer to run a "fast program", in which the drying would have proceeded without the aid of a heat pump. A single-stage heater having a high heating power (e.g. of 1800 W or more), however, could not be used because of the numerous switching cycles required for operation using on-off switching to regulate the power and the resultant problems from mains pollution.

According to the invention, it is also unnecessary to connect the heat pump in parallel with the motor for driving the drying chamber as an alternative to a single-stage heater. In this arrangement, the heat pump would also switch on and off on each occasion that the motor stops and/or reverses. In addition, it would again not be possible to run a fast program with such a configuration, because there would necessarily be a fear of the heat pump overheating.

The tumble dryer according to the invention can be in the form of a condenser dryer or a vented dryer in the sense of the description above. In addition to the configuration of the condenser dryer, a configuration of a vented dryer in particular is possible, in which some of the energy that exists is recovered from the flow of vented air by means of the heat pump, although it must be accepted that in the vented air cooled in this manner there will be moisture condensation that would need to be taken care of. A hybrid form of tumble dryer is also possible, in which, after the process air is used on the laundry to be dried, some of the process air is ducted away and some is recirculated to the laundry. The details of directing the process air and the actual control of the drying process and the devices and measures that may be needed to do this are less relevant to the invention; the invention is more concerned with arranging and interconnecting the existing components so that the tumble dryer and all of its components can be controlled using a reasonably simple control device.

In a preferred embodiment, the heat sink is an evaporator for a working fluid, and the heat source is a condenser for the working fluid, and the heat transfer device comprises a compressor and an expansion valve for the working fluid. This working fluid is selected in particular from the group comprising the known refrigerants R134a, R152a, R290, R407C, R410A and R744. R134a and R152a are fluorinated hydrocarbons (ethane derivatives); R407C and R410A are mixtures of such compounds. R290 is propane, which although relatively flammable is much more preferable for use in a tumble dryer because of its specific combination of advantageous physical properties and very low environmental impact. R744 is carbon dioxide, which although it has a very low critical temperature for the application being considered here and can only be used by employing special measures and apparatus, is entirely non-flammable and also has a very low environmental impact.

In a likewise preferred embodiment of this tumble dryer, the first heating stage has a lower power than the second heating stage. In this case, the first heating stage preferably has a power in the range of 200 to 600 Watts, preferably of 300 to 500 Watts, and the second heating stage has a power in the range of 1000 to 1800 Watts, preferably in the range of 1200 to 1600 Watts.

According to the invention, it is also preferred that the thermostatic switch is arranged in the second circuit.

Moreover, it is preferred that the thermostatic switch is connected on the heat transfer device, in particular at the output of the compressor, or on the heat sink, in particular at the output of the evaporator.

In a preferred embodiment of the tumble dryer according to the invention, the thermostatic switch switches when it reaches or exceeds a preset maximum value $T_{max}$ for a temperature in the heat pump and opens the first circuit or the second circuit.

In an alternative embodiment to the previous embodiment or in an also additional preferred embodiment to the previous embodiment, the thermostatic switch switches when it reaches or goes below a preset minimum value $T_{min}$ for a temperature in the heat pump and closes the opened circuit, i.e. the first circuit or the second circuit.

It is also preferred according to the invention if the first fan is located in the process-air duct between the heat source, in particular the condenser, and the heater.

In another preferred embodiment, an air-air heat exchanger is located in the process-air duct and/or in a cooling-air duct. The air-air heat exchanger can be used in particular for additional cooling of the moisture-laden air and condensing the moisture contained in it. Preferably, however, in the air-air heat exchanger, the heat of the process air is taken from the drying chamber for additional heating of the process air flowing towards the drying chamber. In this case, the air-air heat exchanger can preferably be located in the process-air duct running from a process-air intake in the dryer installation room before the heat sink of the heat pump, between the heat sink and a first fan or between one such first fan and the heater.

In a further preferred embodiment of the invention, an air-air heat exchanger and a second fan are located in a cooling-air duct.

In another preferred embodiment, the air-air heat exchanger can be removed. This is particularly advantageous because a removable heat exchanger can be cleaned more easily of lint.

The subject matter of the invention is also a method for operating a tumble dryer comprising a drying chamber for the articles to be dried, a process-air duct, in which is located a heater for heating the process air and in which the heated process air can be directed by a first fan over the articles to be dried in the drying chamber, and comprising a heat pump having a heat sink, a heat source and a heat transfer device, and also a controller, wherein the heater is a two-stage heater having a first heating stage in a first circuit and a second heating stage in a second circuit parallel to the first, with a thermostatic switch that is thermally coupled to the heat pump being arranged in the first circuit or in the second circuit, in which method the heater having the first heating stage and the second heating stage is operated, and the thermostatic switch is switched when it reaches or exceeds a preset maximum value $T_{max}$ for a temperature in the heat pump and opens the first circuit or the second circuit.

In the method according to the invention, it is preferred that the first heating stage has a lower power than the second heating stage. Here, the first heating stage preferably has a power in the range of 200 to 600 Watts, in particular of 400 to 800 Watts, and the second heating stage has a power in the range of 1000 to 1800 Watts, in particular of 1200 to 1600 Watts.

Furthermore, it is preferred in the method according to the invention that the thermostatic switch is arranged in the second circuit.

During operation of the tumble dryer according to the invention, the refrigerant circuit is heated, for example in a drying process provided according to the invention as a standard operating mode ("standard program"; use of heater, air-air heat exchanger and heat pump). After reaching a temperature for tripping the thermostatic switch, for example the switching temperature $T_{max}$, one of the two heating stages is switched off, preferably the heating stage having the higher heating power. The drying process then runs only using the one heating stage, i.e. one heating power. The refrigerant circuit is preferably designed here so that the heat pump does not go below the switching temperature $T_{max}$ again at the location of the temperature sensor. This results in rapid heating of the process air.

In a drying process provided according to the invention as a "fast program", in which only the heater but no heat pump is used, the refrigerant circuit remains cold. The thermostatic switch and hence the first and the second circuit remain closed, so that heating is performed using two heating stages together, i.e. the process air is heated using maximum heating power.

The invention has the advantage that a tumble dryer comprising a heat pump, a heater and an air-air heat exchanger can be operated very efficiently. A controller known for tumble dryers can be used here, so that there is no need to develop a new controller. Furthermore, the operation of the tumble dryer according to the invention involves fewer problems as regards the mains pollution associated with switching a heating stage having a high heating power.

DETAILED DESCRIPTION OF EXEMPLARY EMBODIMENTS OF THE PRESENT INVENTION

Further details of the invention follow from the description below of an exemplary embodiment, which is not restrictive, of the tumble dryer according to the invention and a method using this dryer. Reference is made to FIG. 1.

FIG. 1 shows a schematic diagram of a process-air circuit and a heat pump 6,7,8,9 for the tumble dryer 1, which here is in the form of a condenser dryer 1. In the dryer, process air is carried in a circuit of a heat transfer device 8,9 comprising the compressor 8 and the expansion valve 9. The process air is heated in the condenser 7 as the heat source 7 of the heat pump 6, 7, 8, 9 and conveyed by means of a first fan 5 to a heater 4 having a first heating stage 12 in a first circuit 14 and a second heating stage 13 in a circuit 15 parallel to the first, where it is heated further. The heated process air enters the drying chamber 3, where it can dry damp laundry (not shown here) by absorbing moisture. The moisture-laden warm process air then exits the drying chamber 3 and is conducted in the process-air duct 2 via an air-air heat exchanger 18 further to the heat sink 6 in the form of an evaporator 6 of the heat pump 6,7,8,9. Moisture-laden warm process air cools here, depositing moisture in the form of condensate. This is collected in a condensate container (not shown here). The cooled process air from which the moisture has been removed is then fed again to the condenser 7, thereby closing the process-air circuit. The heat-pump refrigerant vaporized in the evaporator 6 is conducted via the compressor 8 to the condenser 7. In the condenser 7, the refrigerant is condensed, releasing heat to the air in the process-air duct 2. The refrigerant, which now exists in liquid form, is conducted via the expansion valve 9 again to the evaporator 6, thereby closing the circuit.

A thermostatic switch 16 is integrated in the second circuit 15 of the second heating stage 13 of the heater 4. In this case, the thermostatic switch 16 is switched according to the temperature measured at an output 17 of the evaporator 6. The heater 4 is regulated in the controller 10 by a relay 11.

The air used for cooling in the air-air heat exchanger 18 is taken from the ambient air, which is conveyed via a second fan 21 in a cooling-air duct 19.

A motor 20 is used to drive both the drying chamber 3 in the form of a rotating drum 3 and the first fan 5 and the second fan 21. A third fan 22 can cool the compressor 8 in the embodiment shown in FIG. 1.

The invention claimed is:

1. A dryer, comprising:

a drying chamber for articles to be dried;

a controller;

a heat pump;

a heat exchanger;

a heater which heats process air from the heat pump, the heater having a first heating stage and a second heating stage;

a first fan to direct heated process air to the drying chamber, a second fan to direct ambient air to the heat exchanger, and a third fan to direct air to the heat pump;

a thermostatic switch connected on the heat pump and configured to switch off the second heating stage when a measured temperature at the heat pump one of reaches and exceeds a preset maximum value $T_{max}$ such that process air from the heat pump is heated by the first heating stage.

2. The tumble dryer of claim 1, wherein the second heating stage has a greater power than the first heating stage.

3. A tumble dryer, comprising:

a drying chamber for articles to be dried;

a process-air duct;

a heater arranged to heat process air, wherein the heater is a two-stage heater having a first heating stage in a first circuit and a second heating stage in a second circuit that is parallel to the first circuit;

a first fan to direct heated process air over the articles to be dried in the drying chamber;

a heat pump having a heat sink, a heat source and a heat transfer device;

a controller; and a thermostatic switch arranged in one of the first circuit and the second circuit, wherein the thermostatic switch is thermally coupled to the heat pump and switches and opens one of the first circuit and the second circuit when a measured temperature in the heat pump one of reaches and exceeds a preset maximum value $T_{max}$.

4. The tumble dryer of claim 3, wherein the heat sink is an evaporator for a working fluid; wherein the heat source is a condenser for the working fluid; and wherein the heat transfer device includes a compressor and an expansion valve for the working fluid.

5. The tumble dryer of claim 3, wherein the first heating stage has a lower power than the second heating stage.

6. The tumble dryer of claim 5, wherein the first heating stage has a first power in the range of 200 to 600 Watts, and wherein the second heating stage has a second power in the range of 1000 to 1800 Watts.

7. The tumble dryer of claim 3, wherein the thermostatic switch is arranged in the second circuit.

8. The tumble dryer of claim 3, wherein the thermostatic switch is connected on one of the heat transfer device and the heat sink.

9. The tumble dryer of claim 3, wherein, when a measured temperature in the heat pump one of reaches and goes below a preset minimum value $T_{min}$, the thermostatic switch switches and closes one of the first circuit and the second circuit.

10. The tumble dryer of claim 3, wherein the first fan is located in the process-air duct between the heat source and the heater.

11. The tumble dryer of claim 3, wherein an air-air heat exchanger is located in at least one of the process-air duct and a cooling-air duct.

12. The tumble dryer of claim 11, further comprising a second fan, wherein the air-air heat exchanger and the second fan are located in the cooling-air duct.

13. A method for operating a tumble dryer having a drying chamber for articles to be dried, a process-air duct; a heater arranged to heat process air, wherein the heater is a two-stage heater having a first heating stage in a first circuit and a second heating stage in a second circuit that is parallel to the first circuit; a first fan to direct heated process air over the articles to be dried in the drying chamber; a heat pump having a heat sink, a heat source and a heat transfer device; a controller; and a thermostatic switch arranged in one of the first circuit and the second circuit, wherein the thermostatic switch is thermally coupled to the heat pump; the method comprising:

operating the heater having the first heating stage and the second heating stage; and switching the thermostatic switch and opening one of the first circuit and the second circuit when a measured temperature in the heat pump one of reaches and exceeds a preset maximum value $T_{max}$.

14. The method of claim 13, wherein the first heating stage has a lower power than the second heating stage.

15. The method of claim 13, wherein the first heating stage has a first power in the range of 200 to 600 Watts, and wherein the second heating stage has a second power in the range of 1000 to 1800 Watts.

16. The method of claim 13, wherein the thermostatic switch is arranged in the second circuit.

17. A dryer, comprising:

a drying chamber;

a controller;

a heat pump having a heat sink, a heat source and a heat transfer device;

a heater which heats process air from the heat pump, the heater having a first heating stage and a second heating stage in parallel with the first heating stage and with a greater power than the first heating stage;

a heat exchanger located in at least one of a process-air duct and a cooling-air duct; and a thermostatic switch connected on the heat pump and configured to switch off the second heating stage when a measured temperature at the heat pump one of reaches and exceeds a preset maximum value $T_{max}$ such that process air from the heat pump is heated by the first heating stage, and switch on the second heating stage when a measured temperature at the heat pump one of reaches and falls below a preset minimum value $T_{min}$ such that process air from the heat pump is heated by the first heating stage and the second heating stage.

18. The tumble dryer of claim 17, wherein the thermostatic switch is connected on the output of the compressor of the heat transfer device.

19. The tumble dryer of claim 17, wherein the thermostatic switch is connected on the output of an evaporator of the heat sink.

* * * * *